US006062150A

United States Patent [19]

Sikora et al.

[11] Patent Number: 6,062,150

[45] Date of Patent: May 16, 2000

[54] SYSTEM FOR PRODUCING THREE DIMENSIONAL STRUCTURES

[75] Inventors: Günther Sikora; Gerhard Sikora, both of Steyr, Austria

[73] Assignee: Gunther Sikora, Austria

[21] Appl. No.: 09/091,284

[22] PCT Filed: Nov. 14, 1996

[86] PCT No.: PCT/AT96/00220

§ 371 Date: Jun. 15, 1998

§ 102(e) Date: Jun. 15, 1998

[87] PCT Pub. No.: WO97/23150

PCT Pub. Date: Jul. 3, 1997

[30] Foreign Application Priority Data

Dec. 22, 1995 [AT] Austria ..... 2095/95

[51] Int. Cl.[7] ..... A47B 7/02

[52] U.S. Cl. ..... 108/190; 108/91; 211/186; 211/188

[58] Field of Search ..... 108/91, 147.12, 108/147.13, 147.14, 147.15, 153.1, 180, 192, 190; 211/126.2, 133.1, 186, 187, 188; 248/188, 235

[56] References Cited

U.S. PATENT DOCUMENTS

| | | | |
|---|---|---|---|
| 397,225 | 2/1889 | Clow | 108/153.1 X |
| 2,944,780 | 7/1960 | Monk | 108/192 X |
| 3,338,605 | 8/1967 | Stoeber | 211/188 X |
| 3,730,601 | 5/1973 | Misenheimer, III | 108/190 |
| 3,783,801 | 1/1974 | Engman | 108/190 X |
| 3,851,601 | 12/1974 | Davis | 108/192 |
| 3,869,218 | 3/1975 | Stoeber et al. | 108/190 X |
| 4,128,064 | 12/1978 | Chung et al. | 108/147.13 X |
| 4,138,953 | 2/1979 | Tashman . | |
| 4,145,977 | 3/1979 | Yellin | 108/190 |
| 4,158,336 | 6/1979 | Brescia et al. | 108/190 |
| 4,237,798 | 12/1980 | Welsch et al. | 108/192 |
| 4,275,666 | 6/1981 | Schriever | 108/190 X |
| 4,474,416 | 10/1984 | Rogahn | 108/192 X |
| 4,615,278 | 10/1986 | Cabrelli | 108/147.13 X |
| 4,627,543 | 12/1986 | Nicely | 211/187 |
| 4,629,077 | 12/1986 | Niblock | 211/187 |
| 4,763,799 | 8/1988 | Cohn et al. | 108/147.13 X |
| 4,799,818 | 1/1989 | Sudimak et al. | 108/147.13 X |
| 4,843,975 | 7/1989 | Welsch et al. | 108/192 X |
| 4,852,501 | 8/1989 | Olson et al. | 108/111 X |
| 4,989,519 | 2/1991 | Welsch et al. | 108/192 |
| 5,127,342 | 7/1992 | Taylor | 211/187 X |
| 5,158,187 | 10/1992 | Taub | 108/190 X |
| 5,183,167 | 2/1993 | Cheng | 108/147.13 X |
| 5,269,419 | 12/1993 | Aldeguer et al. | 108/190 X |
| 5,303,645 | 4/1994 | Meacham | 108/180 X |
| 5,464,305 | 11/1995 | Liem | 108/180 X |
| 5,676,067 | 10/1997 | Breindel | 108/180 X |
| 5,676,263 | 10/1997 | Chang | 108/180 X |
| 5,683,004 | 11/1997 | Aho | 211/187 |
| 5,802,990 | 9/1998 | Lin | 108/192 |
| 5,881,653 | 3/1999 | Pfister | 108/147.13 X |

FOREIGN PATENT DOCUMENTS

| | | | |
|---|---|---|---|
| 0 195 527 | 2/1986 | European Pat. Off. . | |
| 0 410 325 | 1/1991 | European Pat. Off. . | |
| 1 300 853 | 12/1962 | France . | |
| WO 87/01771 | 3/1987 | France . | |
| 2454421 | 5/1976 | Germany | 108/180 |
| 34 18 602 | 11/1985 | Germany . | |
| 90 12 805 u | 11/1990 | Germany . | |
| 43 26 451 | 2/1995 | Germany . | |
| 1 319 737 | 7/1971 | United Kingdom . | |
| 2215988 | 4/1989 | United Kingdom | 108/180 |

*Primary Examiner*—Milton Nelson
*Assistant Examiner*—Brian H. Buck
*Attorney, Agent, or Firm*—Lorusso & Loud; Anthony M. Lorusso

[57] ABSTRACT

A system for producing three-dimensional structures, especially shelving with preferably vertical uprights to which structural components, especially shelves, are releasably attachable, in which the uprights pass through drillings or recesses in the structural components. There are connecting inserts which can be arranged in the region of a drilling or recess in a structural component and secured to the latter via the uprights.

4 Claims, 26 Drawing Sheets

SYSTEM FOR PRODUCING THREE DIMENSIONAL STRUCTURES

BACKGROUND OF THE INVENTION

1. Field of the Invention

The invention concerns a construction system for building three-dimensional structures, in particular shelves with preferably vertical supports to which construction members, in particular panels, can be releasably fixed, wherein the supports extend through bores or openings in the construction members, and wherein there are provided connecting inserts which can each be arranged in the region of a bore or opening in a construction member and by way of which the supports can be connected to the construction members.

Such construction systems can be used in particular for building shelves, wherein there are then provided generally vertical supports and the construction members are in the form of horizontal plates or panels. Other uses however are also certainly conceivable and possible, for example framework structures, exhibitions stands, toys and play items and other three-dimensional structures can be constructed therewith.

2. Description of the Related Art

The connection of the supports which extend through bores or openings in the construction members, to the construction members, is not effected directly but by way of special connecting inserts. Such connecting inserts which are known from EP-A1-0 195 527 make it possible to form a stable connection between the supports and the construction members, even when the construction members are of comparatively small thickness.

BRIEF SUMMARY OF THE INVENTION

The object of the invention is to provide a flexible stable construction system which can be rapidly built, for building three-dimensional structures.

In accordance with the invention that is achieved in that the supports—as is known per se—comprise bars and spacer sleeves which can be pushed thereon, wherein the bars extend through the connecting inserts and the spacer sleeves are arranged between the construction members and are supported at the connecting inserts.

Supports comprising bars and spacer sleeves are already known from GB-A-13 19 737. What is novel however is the idea that the spacer sleeves are supported at the connecting inserts, which permits a stable connection.

BRIEF DESCRIPTION OF THE SEVERAL VIEWS OF THE DRAWINGS

Further advantages and features of the invention are described in greater detail with reference to the following specific description.

Figure 1:
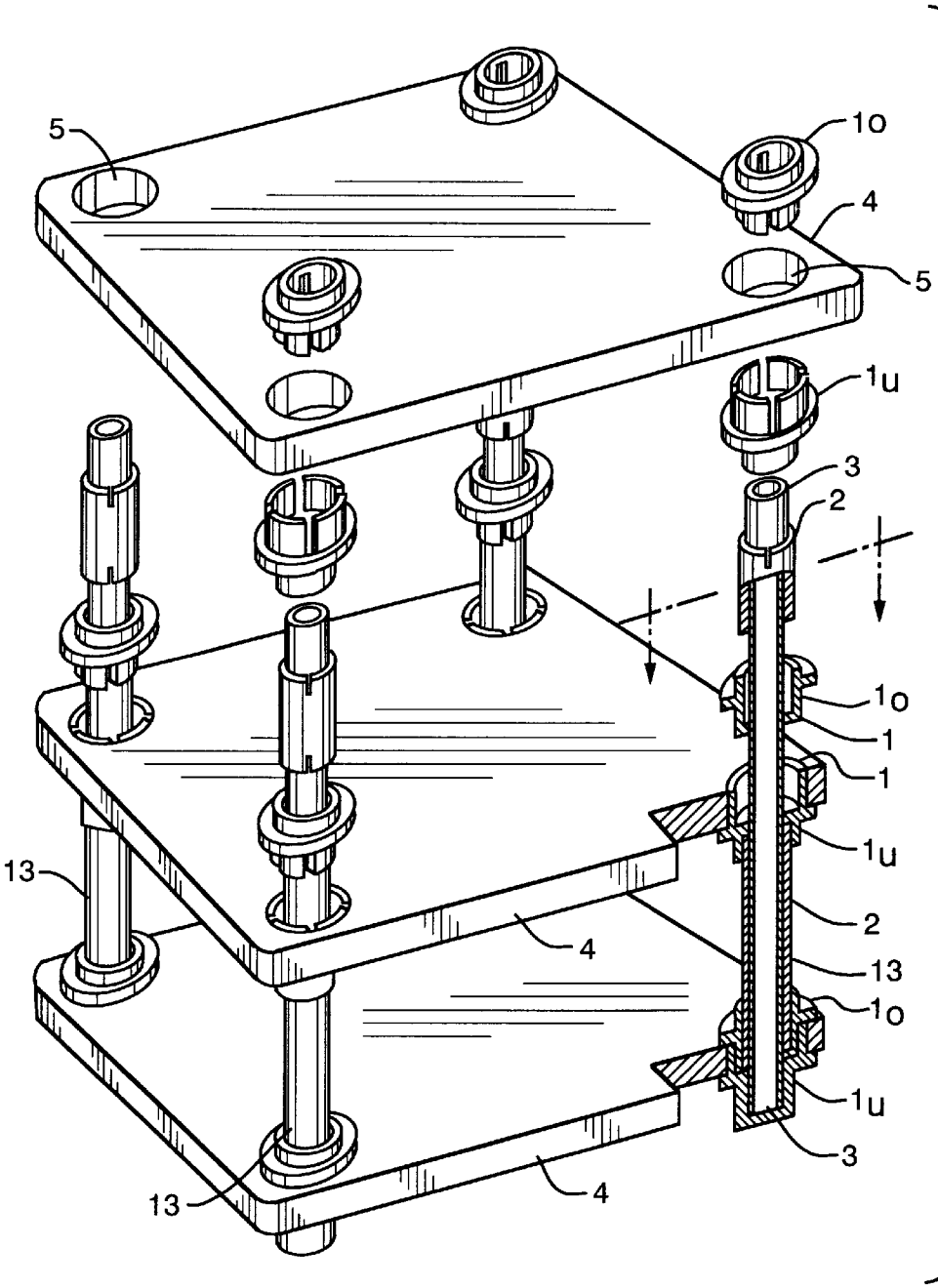
FIG. 1 is a perspective view of a first embodiment of the construction system according to the invention.
Figure 2:
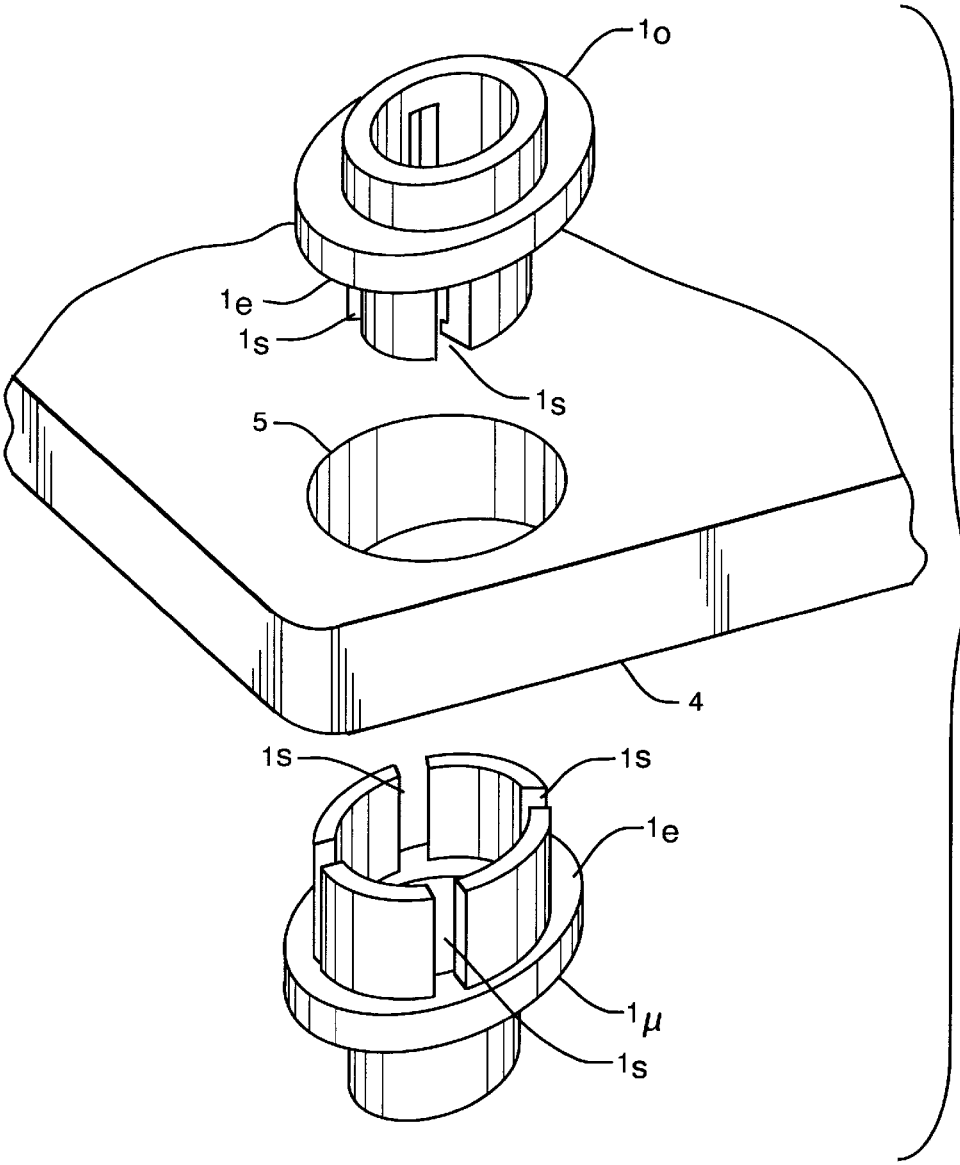
FIG. 2 shows a detail from FIG. 1 and in particular the upper part and the lower part of a two-part connecting insert, FIG. 3 also shows a detail from FIG. 1 with the lower part of the connecting insert already pushed into place, with the inserted bar, and with the sleeve still to be pushed on to the support, FIG. 4 also shows a detail from FIG. 1 in which the connecting inserts are mounted in the finished condition in the construction members.
Figure 3:
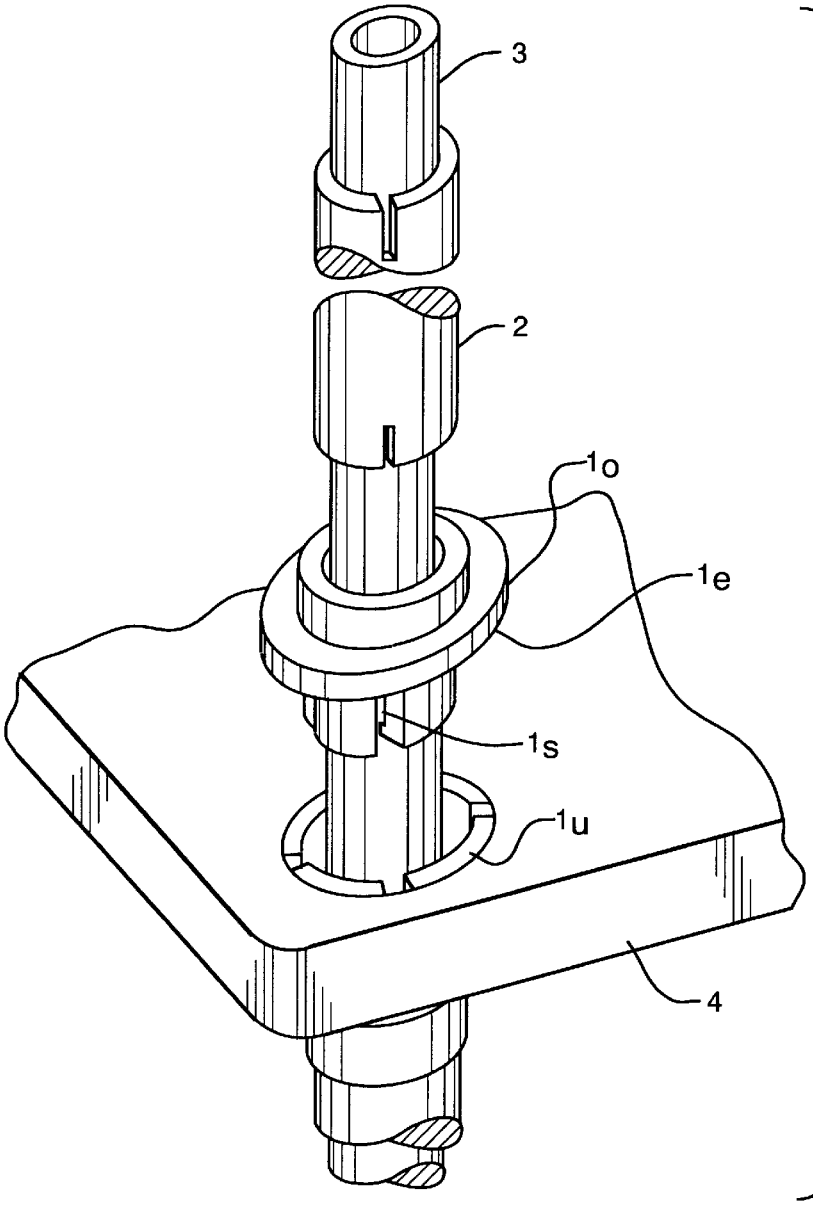
Figure 4:
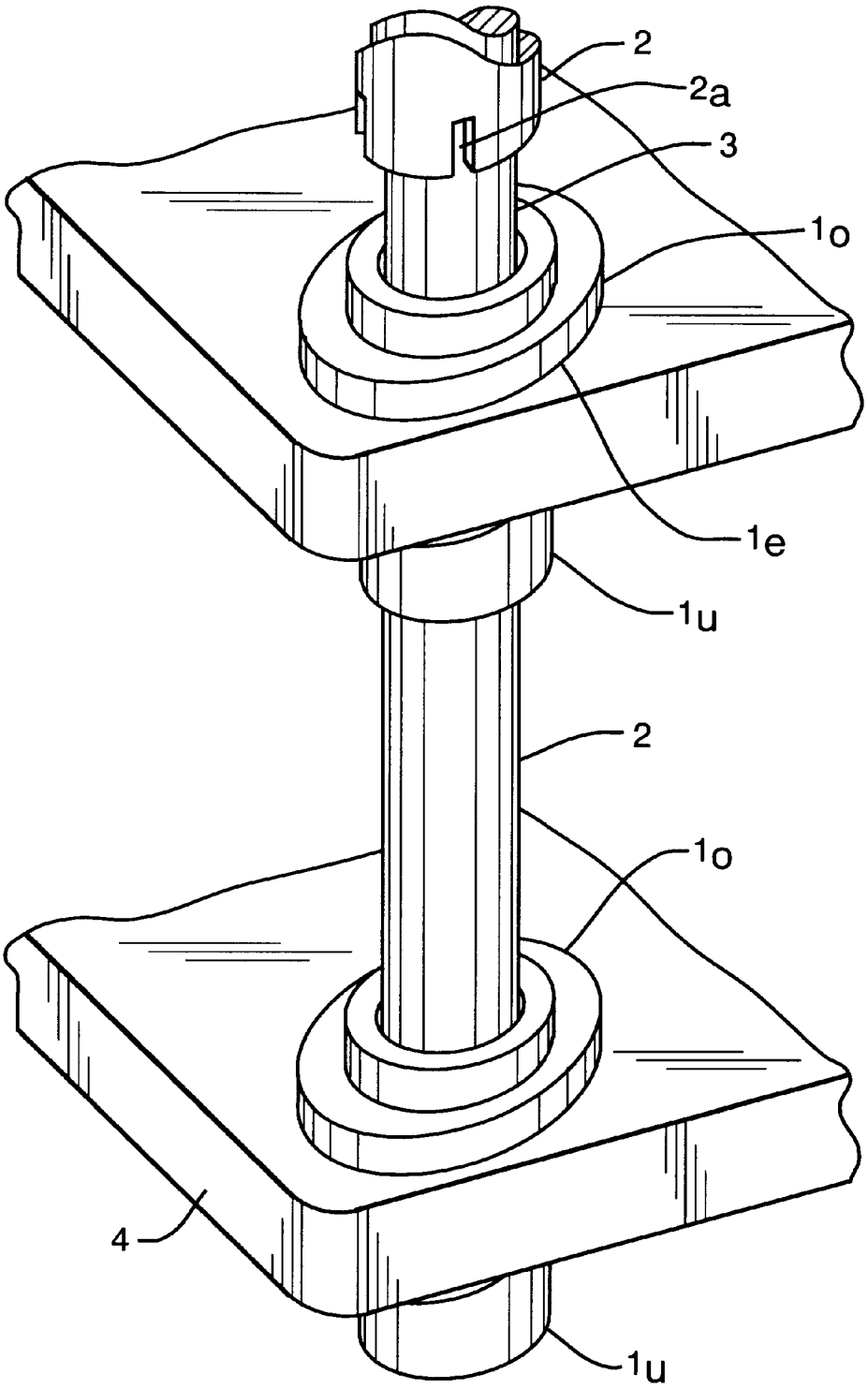
Figure 5:
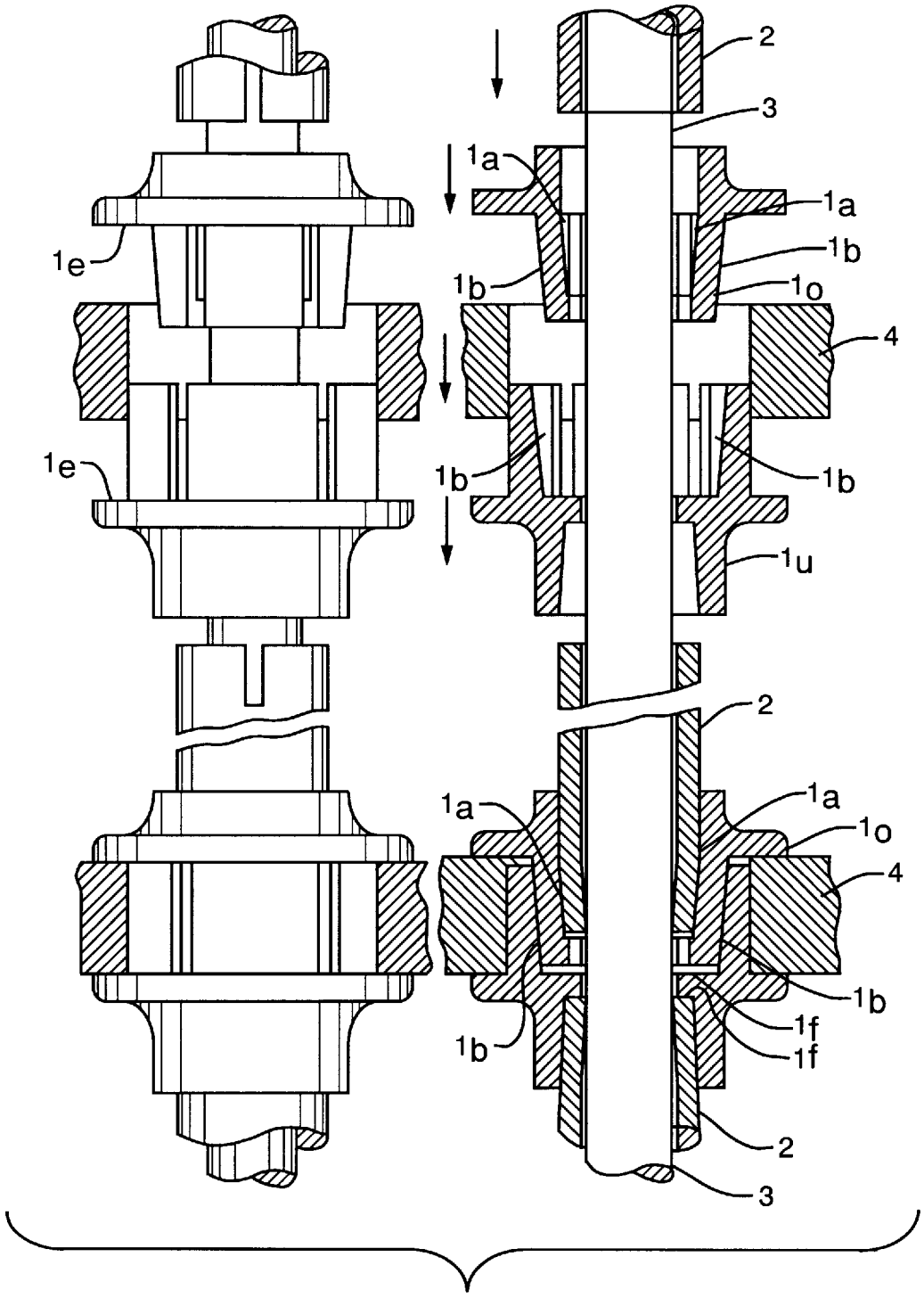
FIG. 5 shows a side view at the left and a sectional view at the right illustrating the assembly of construction members, connecting inserts and supports which comprise bars and spacer sleeves which are pushed thereon.
Figure 6:
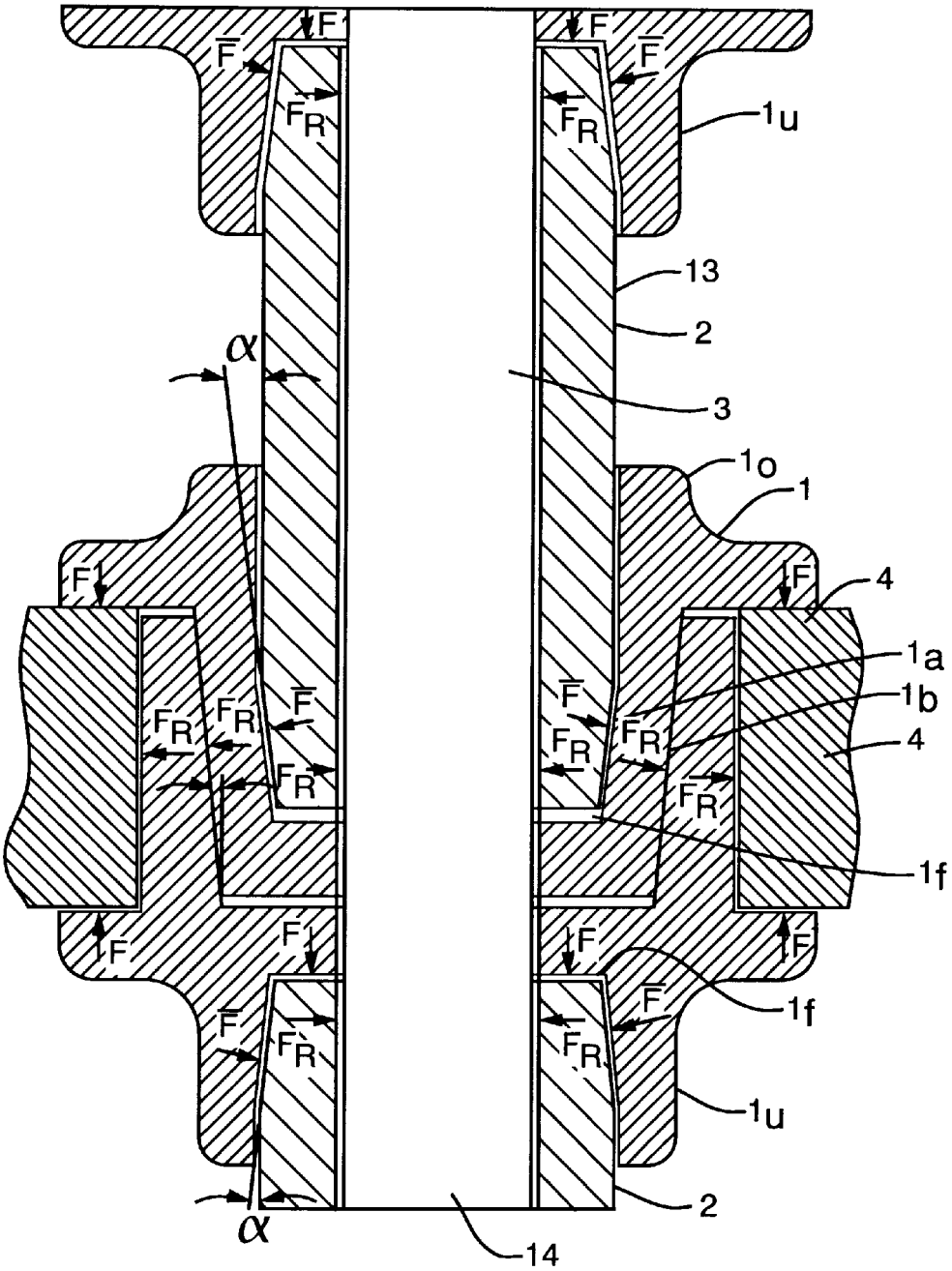
FIG. 6 is a view in vertical section diagrammatically explaining the formation of a clamping force when the construction system is loaded.
Figure 7:
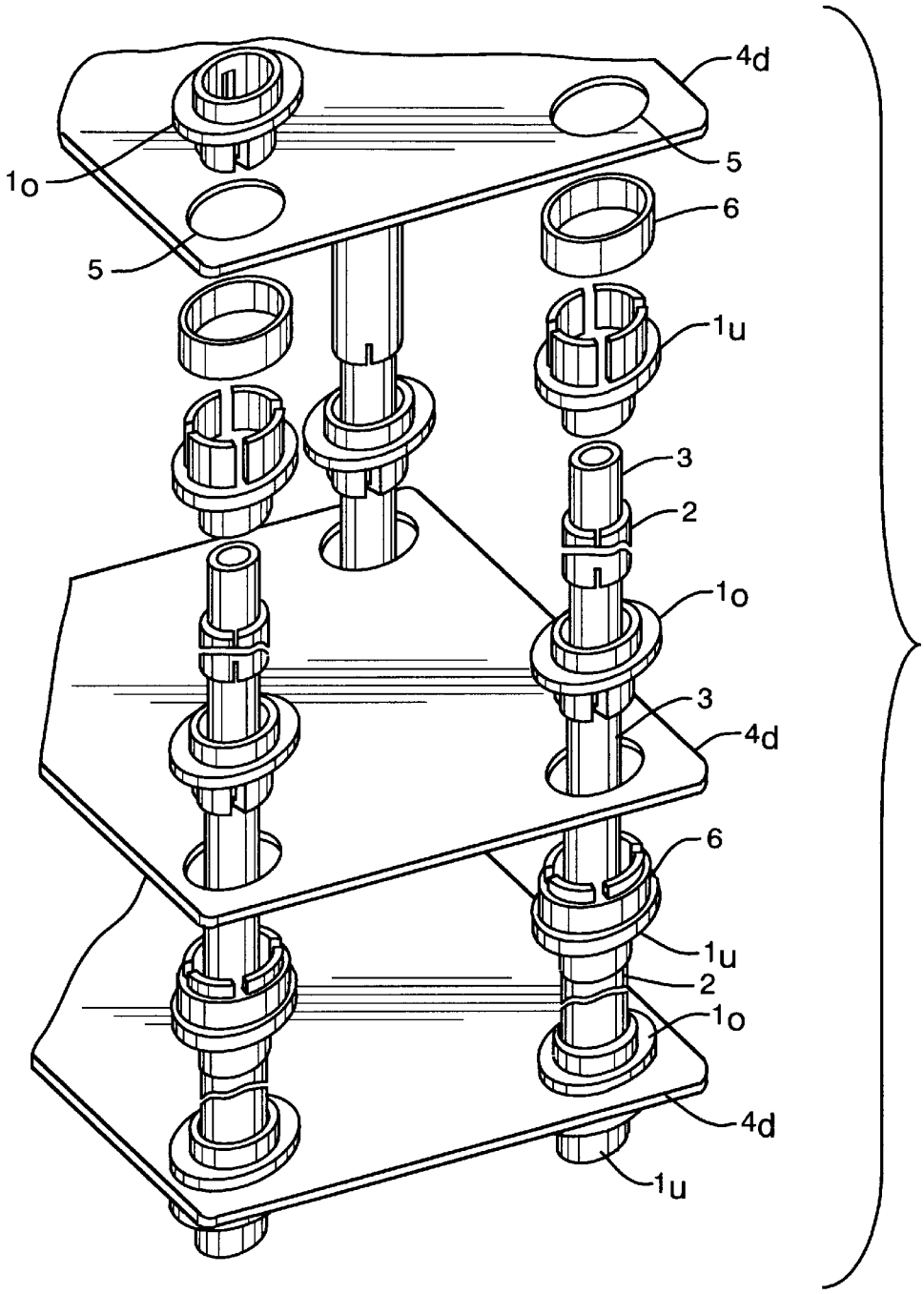
Figure 8A:
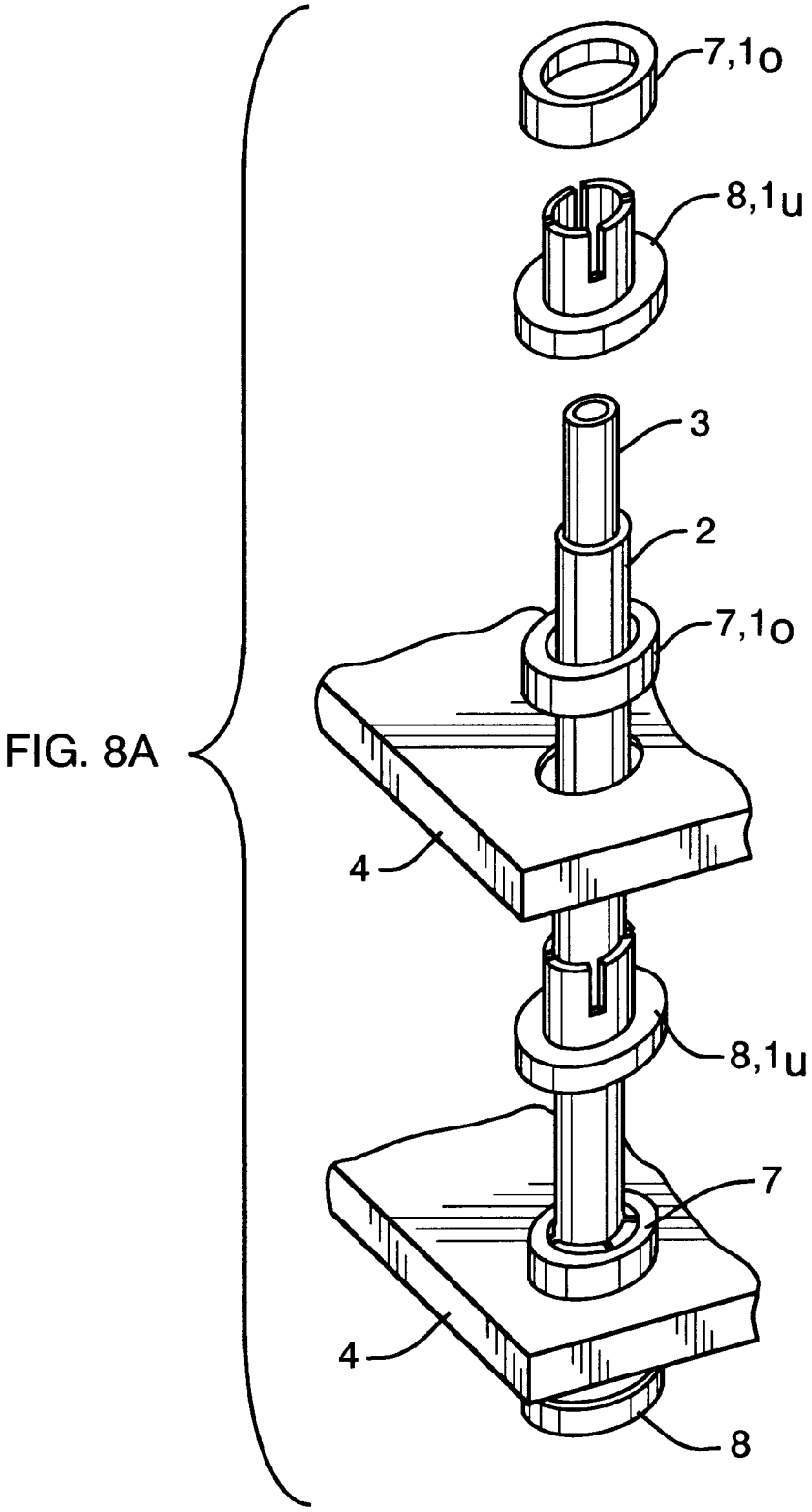
Figure 8B:
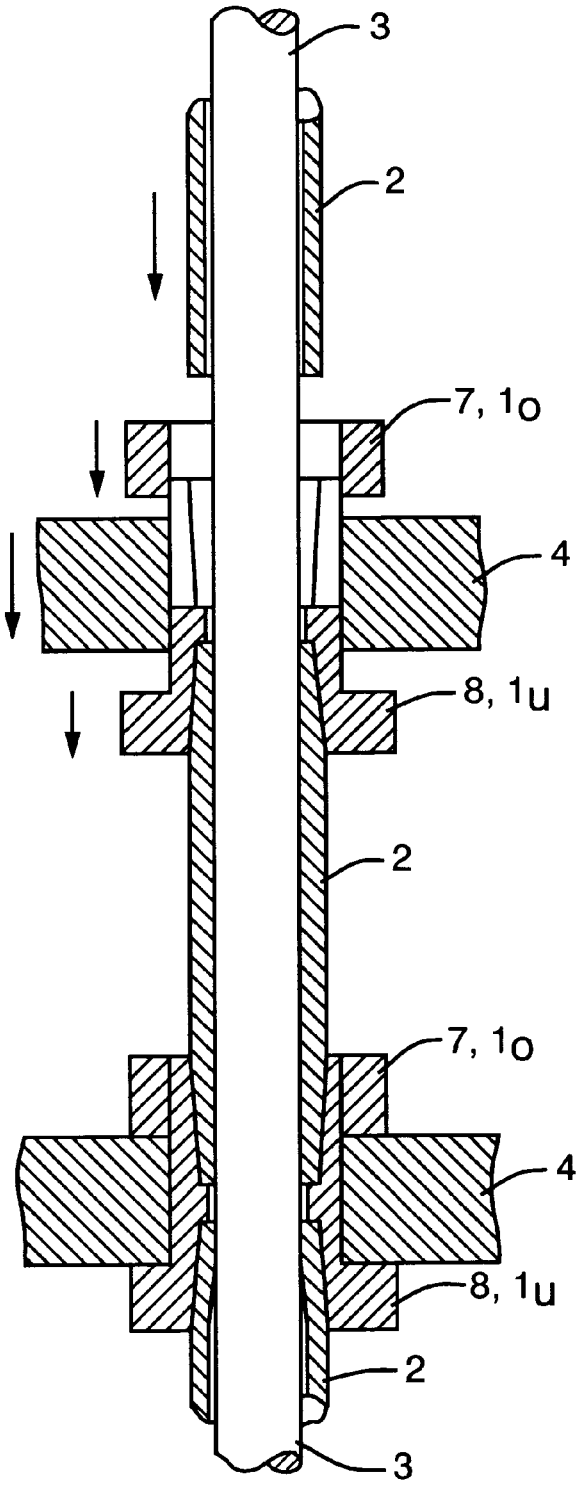
Figure 9A:
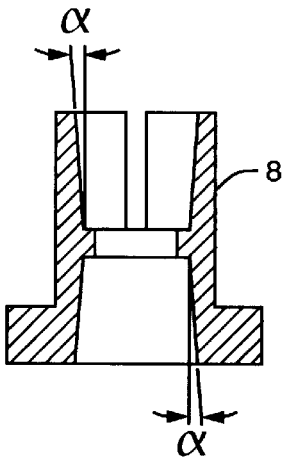
Figure 9B:
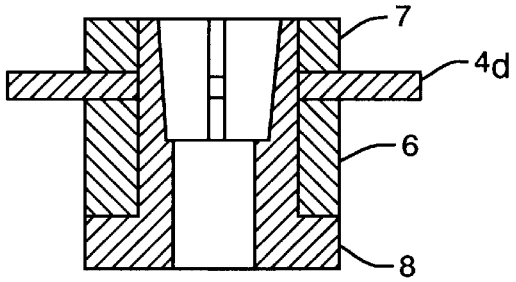
Figure 9C:
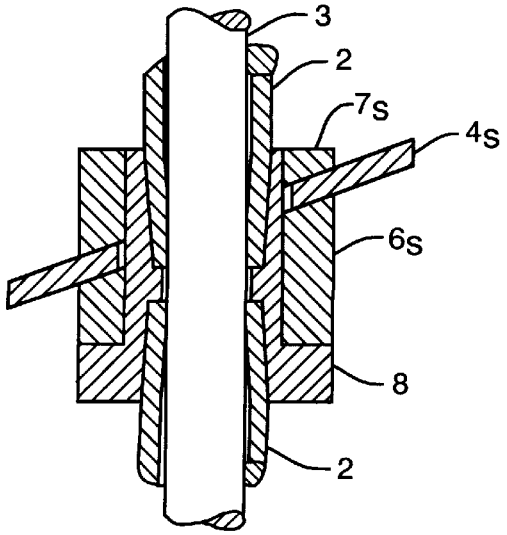
Figure 10:
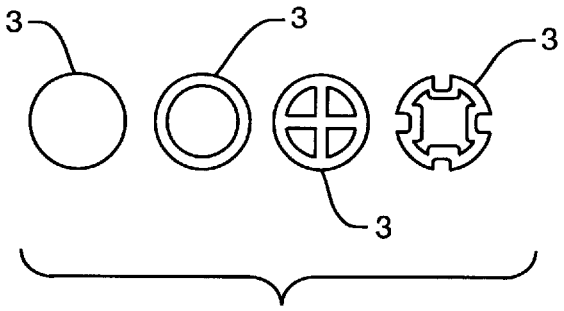
Figure 11A:
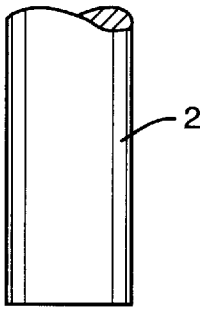
Figure 11B:
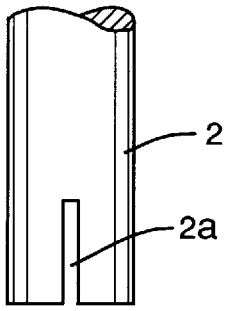
Figure 11C:
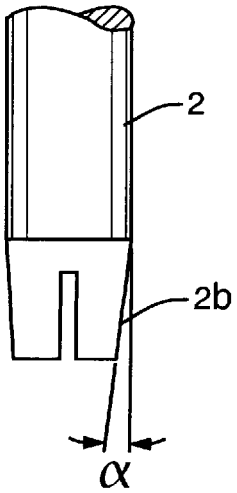
Figure 12:
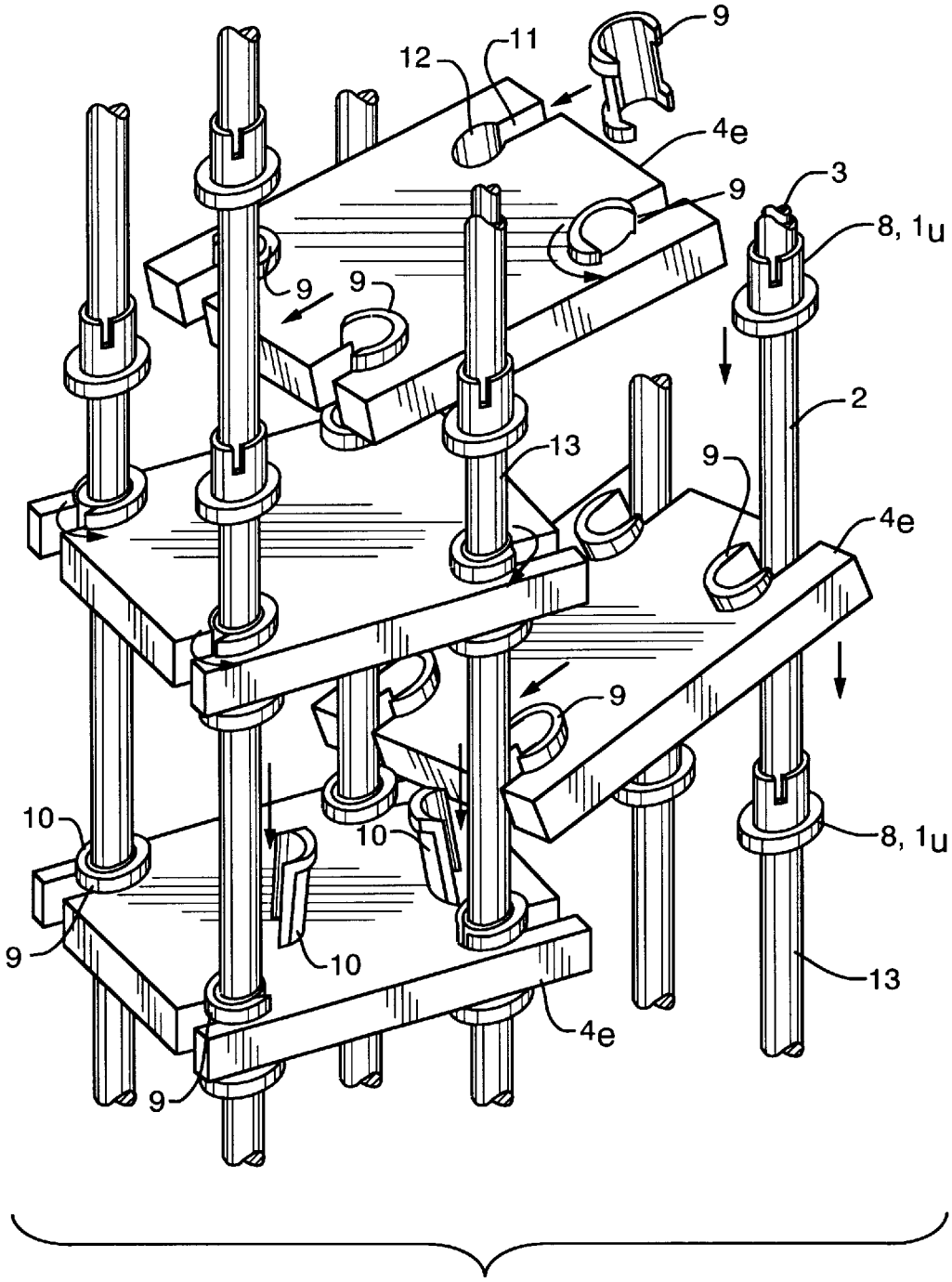
Figure 13:
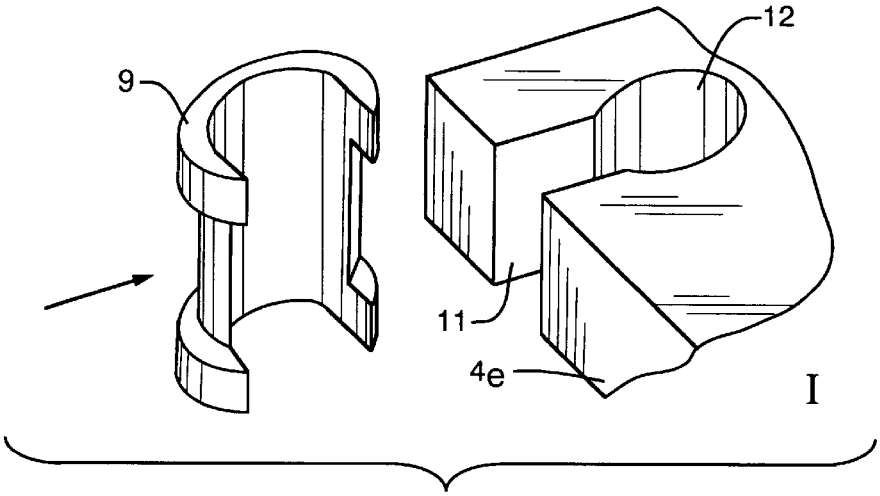
Figure 14:
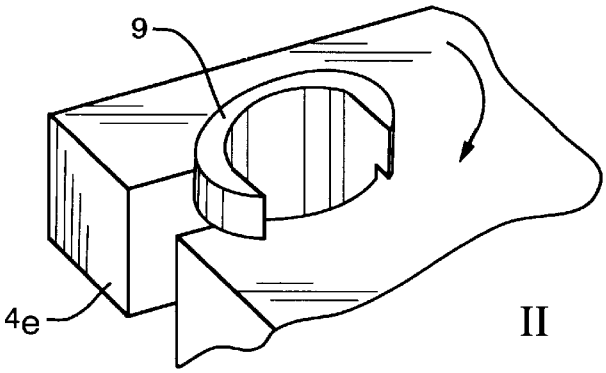
Figure 15:
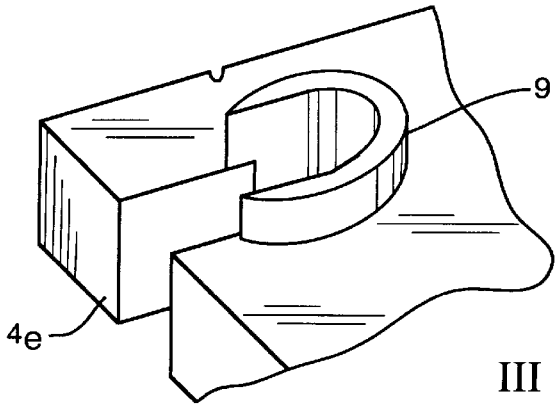
Figure 16:
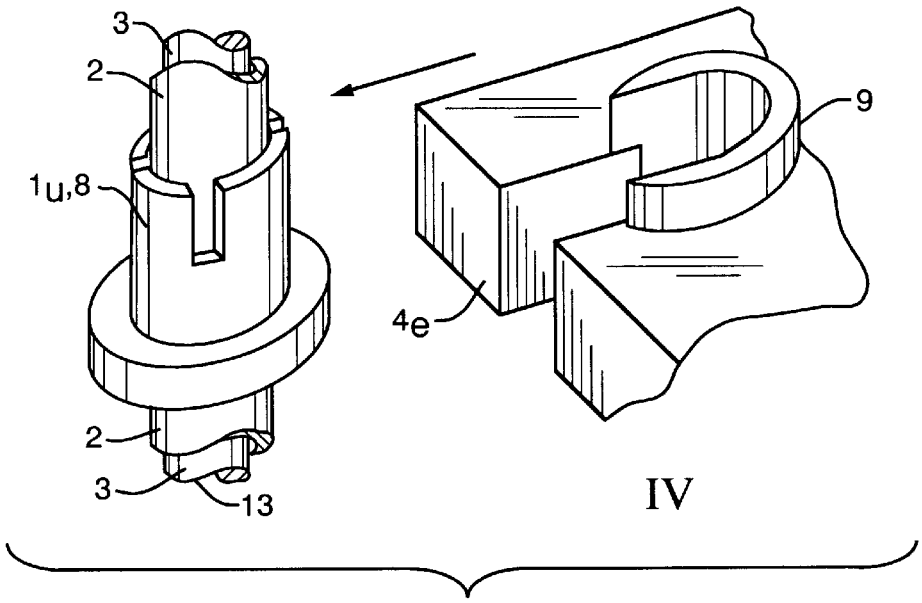
Figure 17:
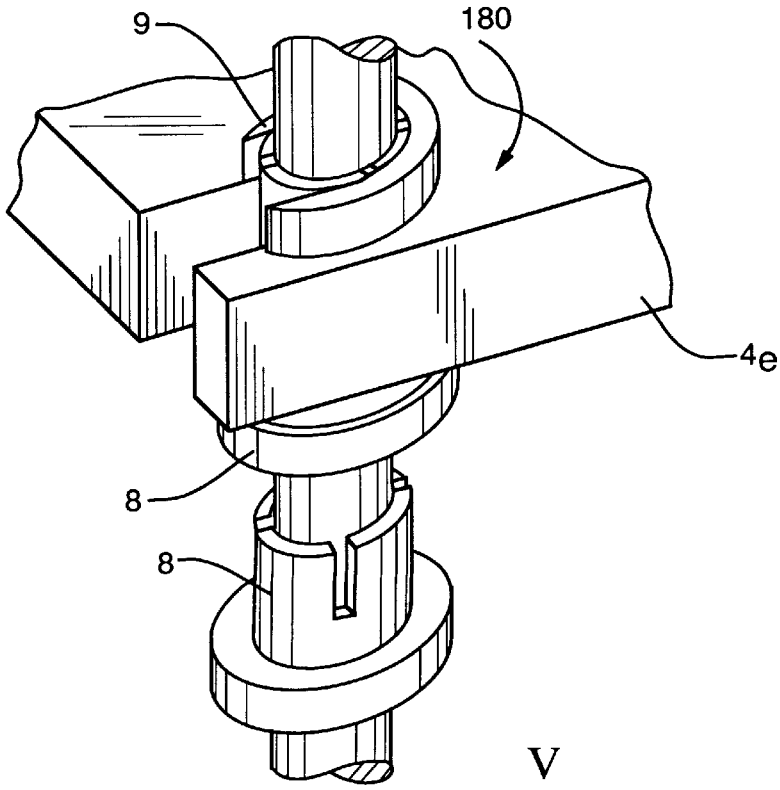
Figure 18:
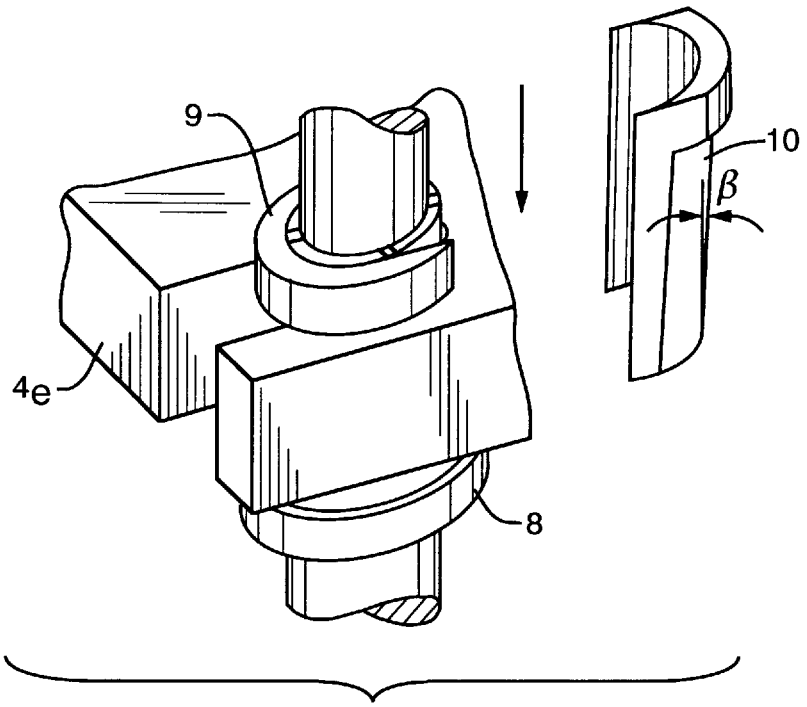
Figure 19:
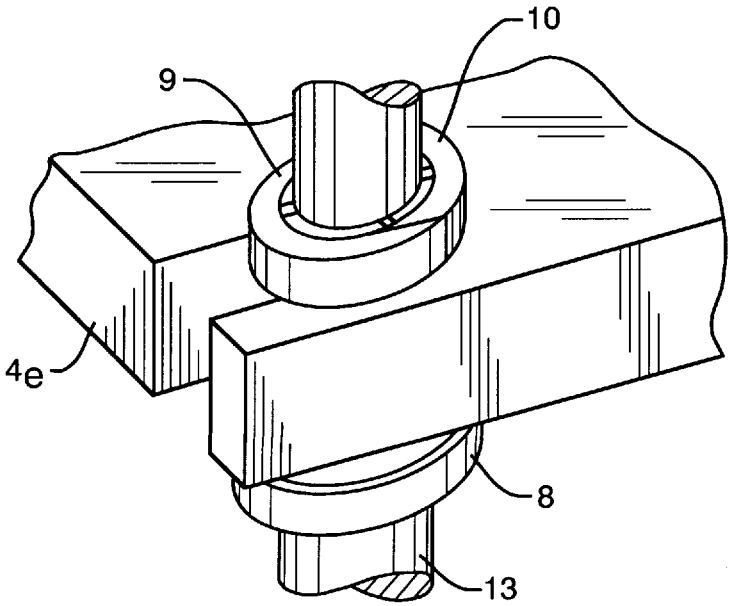
Figure 20A:
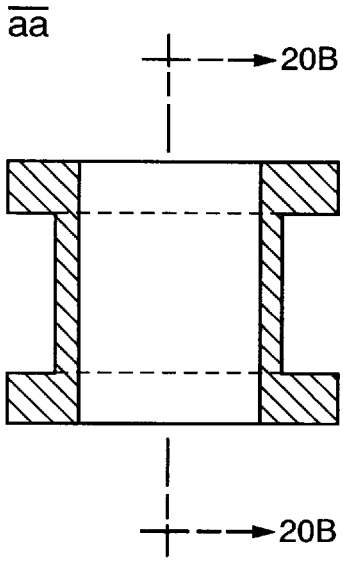
Figure 20B:
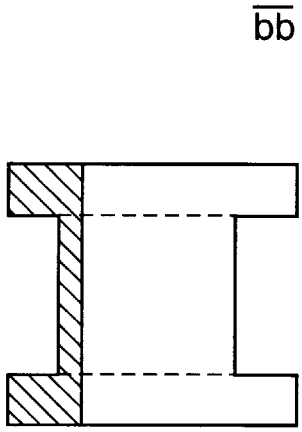
Figure 20C:
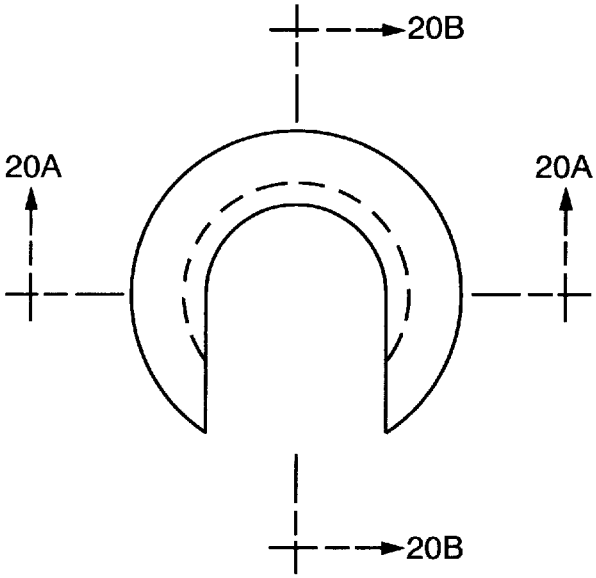
Figure 21A:
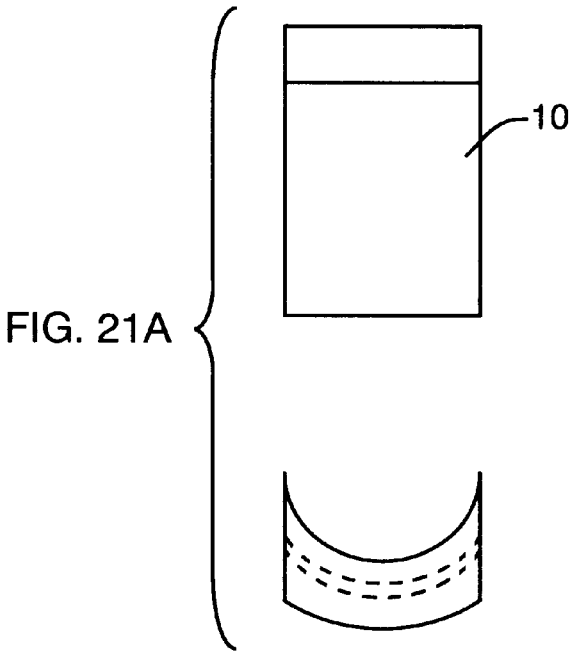
Figure 21B:
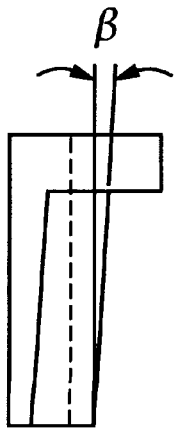
Figure 22A:
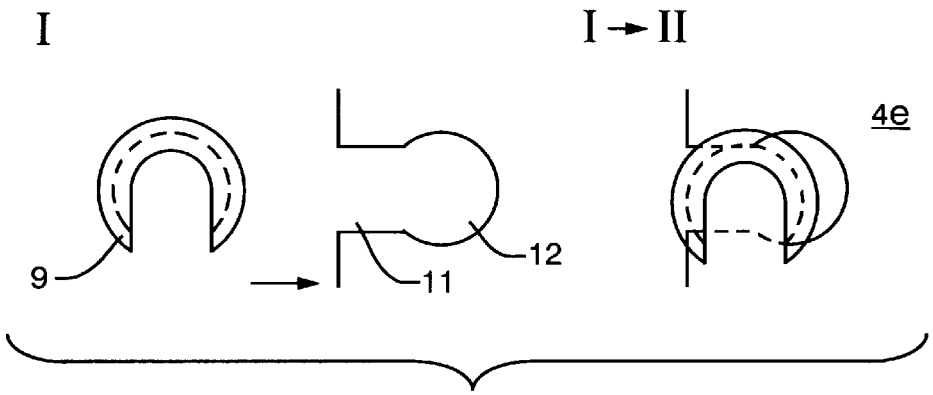
Figure 22B:
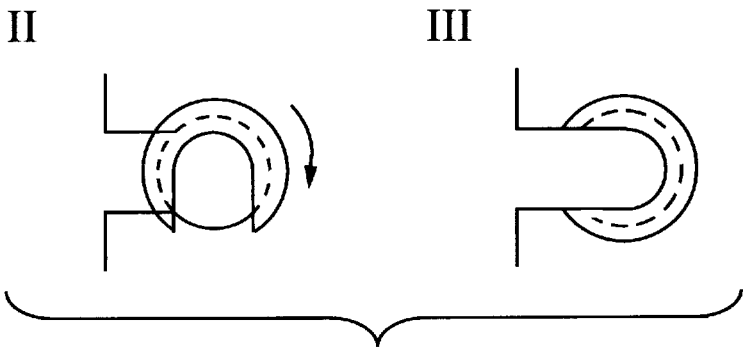
Figure 22C:
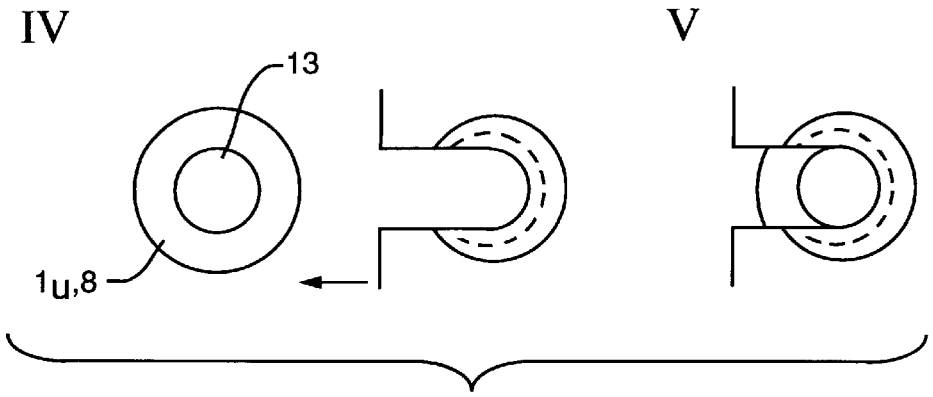
Figure 22D:
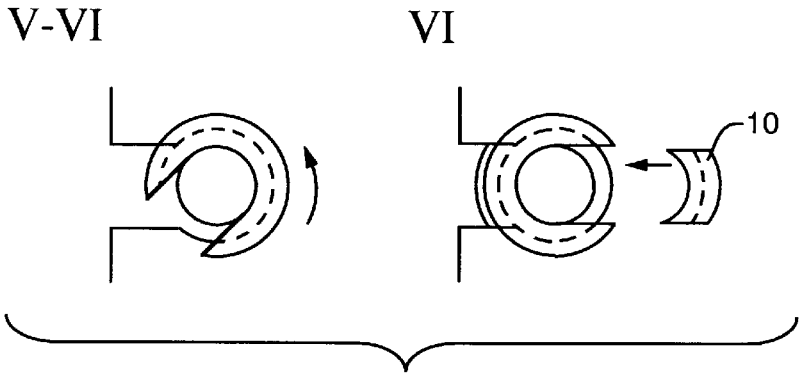
Figure 22E:
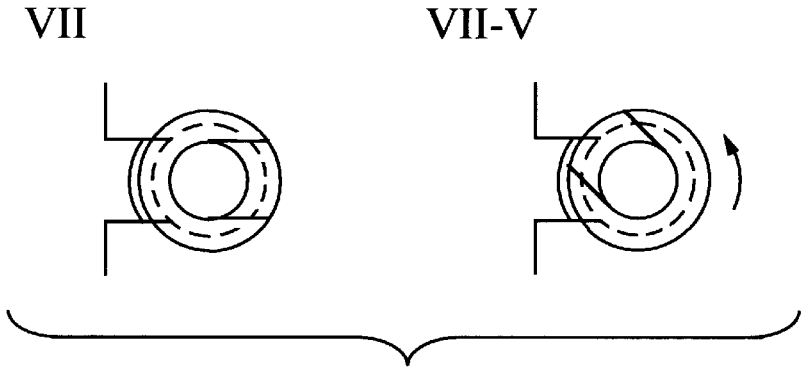
Figure 22F:
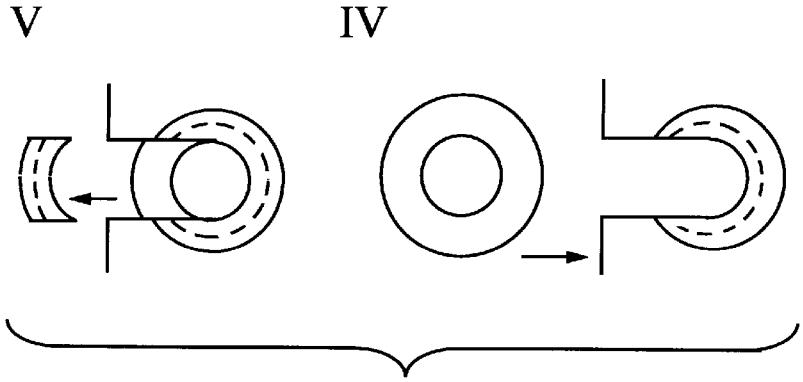
Figure 23A:
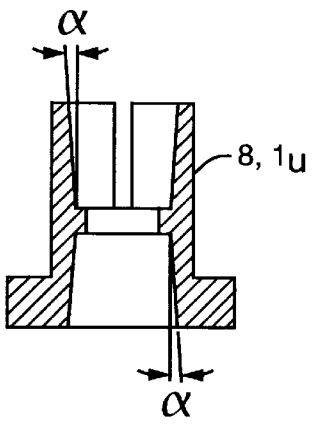
Figure 23B:
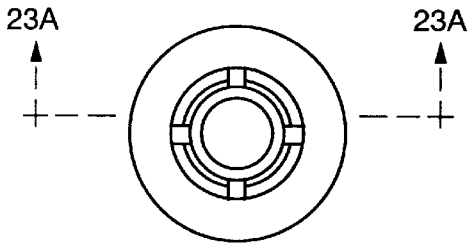
Figure 23C:
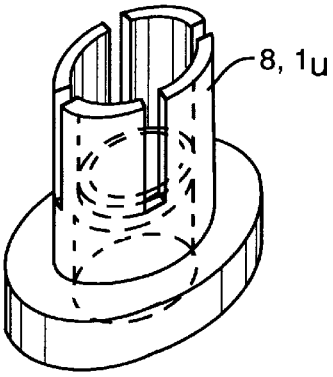
Figure 23D:
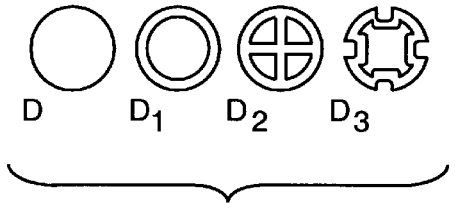
Figure 23E:
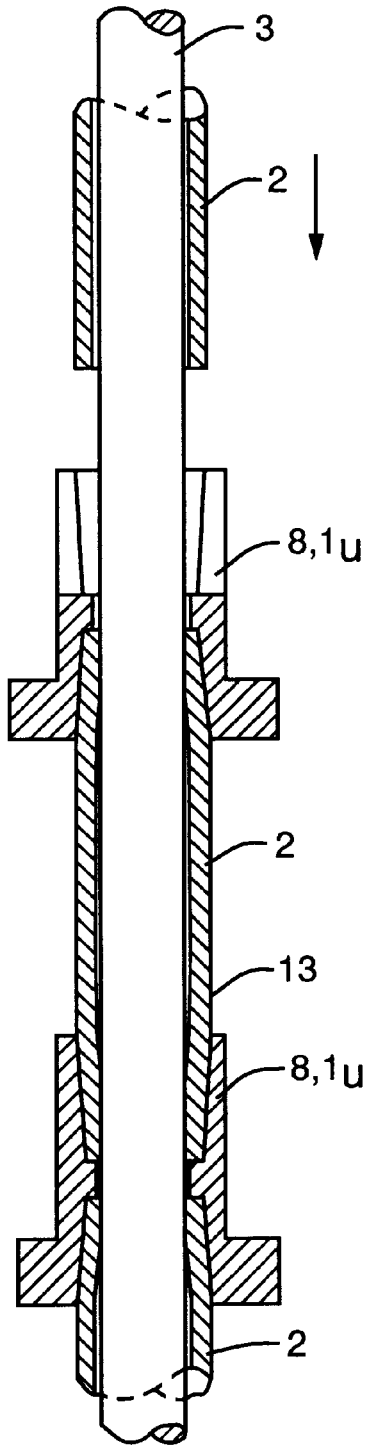
Figure 24:
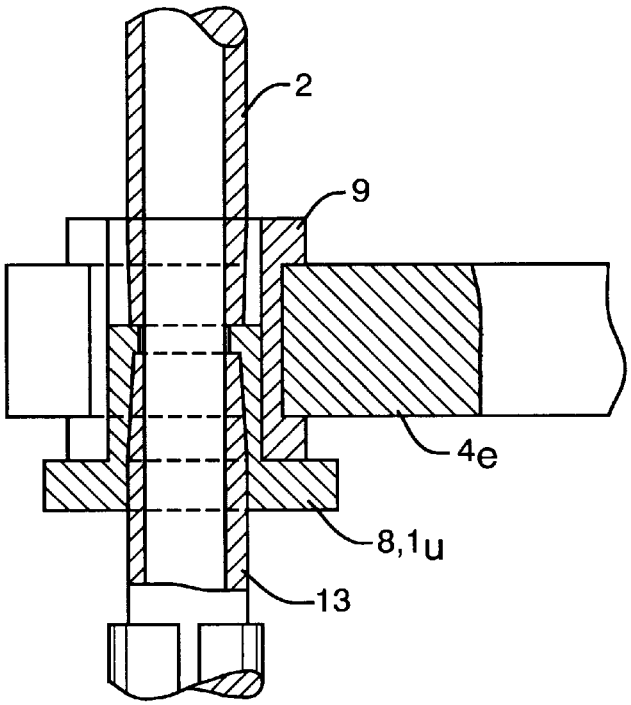
Figure 25:
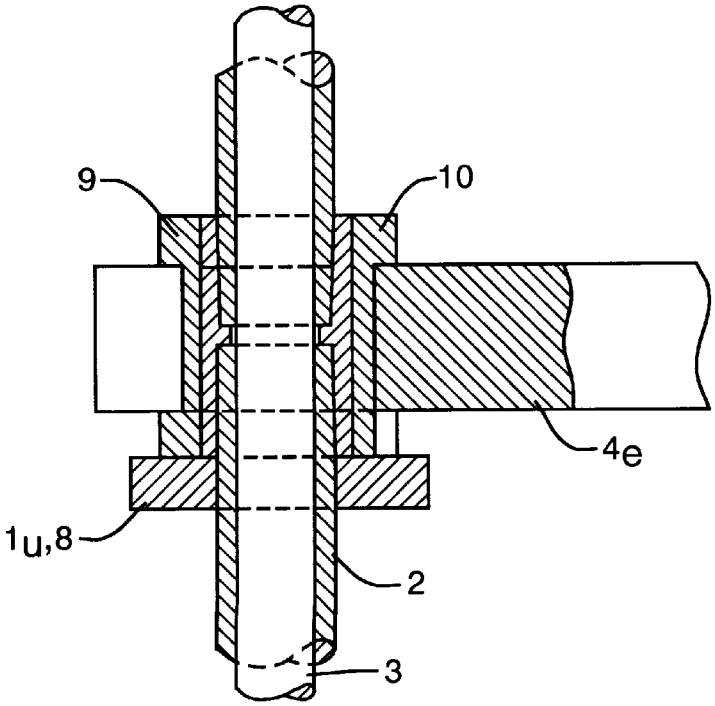
Figure 26A:
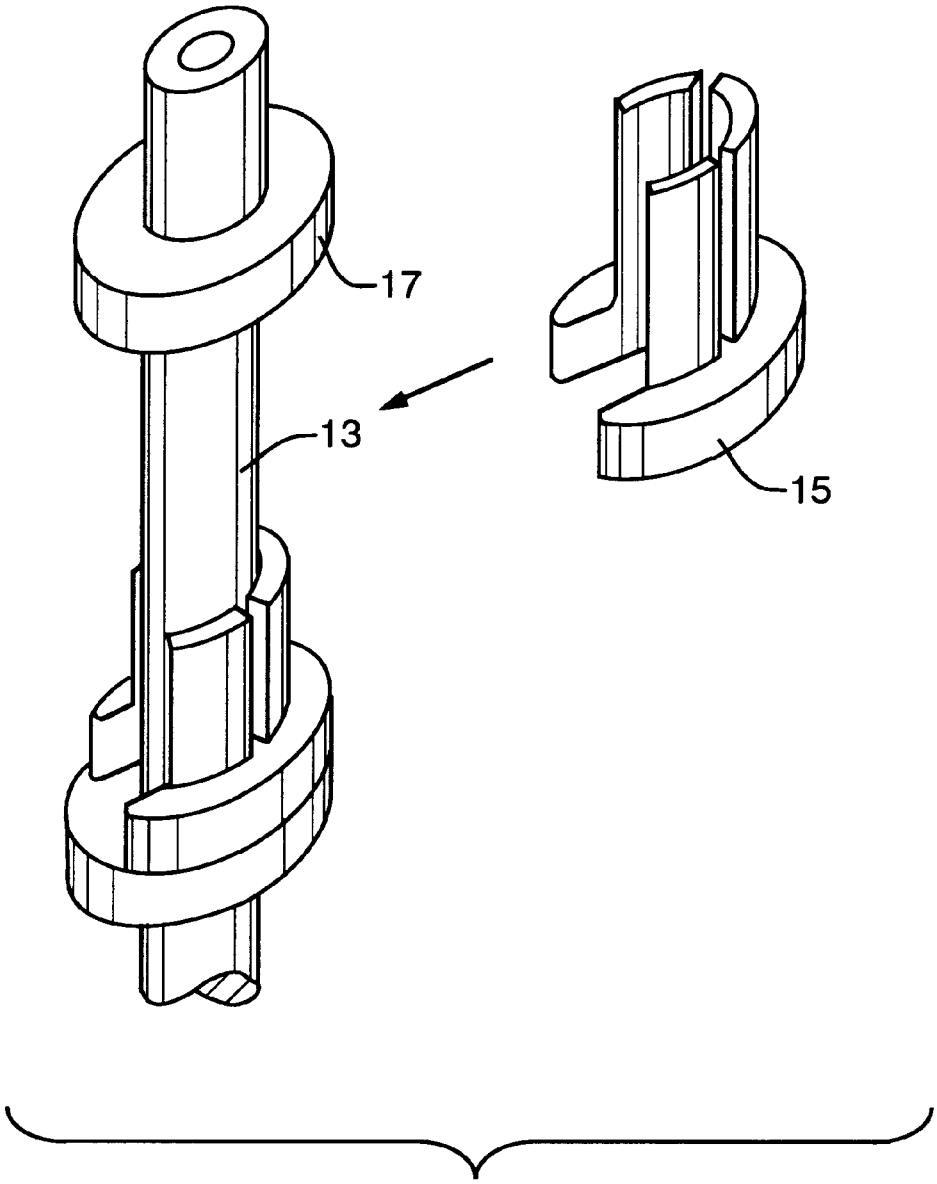
Figure 26B:
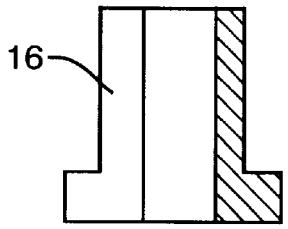
Figure 26C:
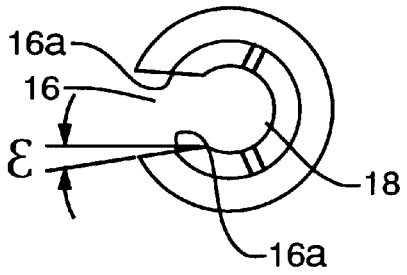
Figure 27:
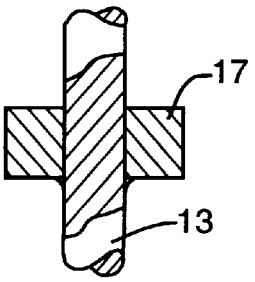
Figure 28:
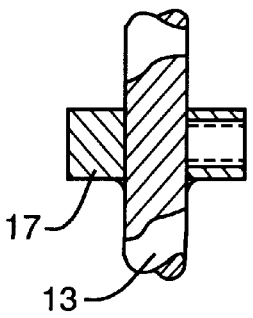
Figure 29:
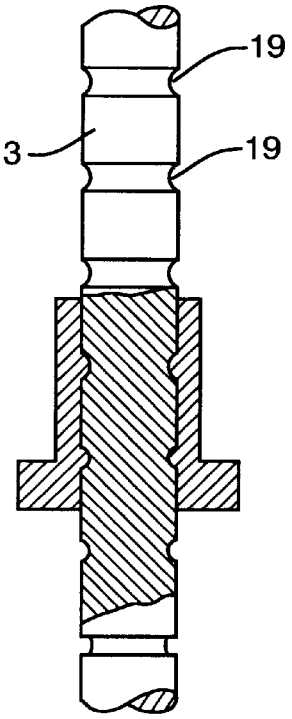
Figure 30:
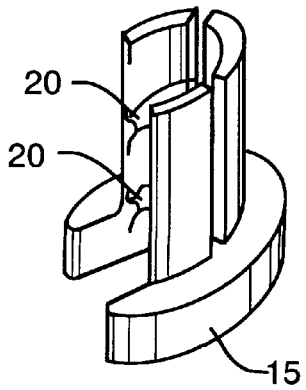
Figure 31:
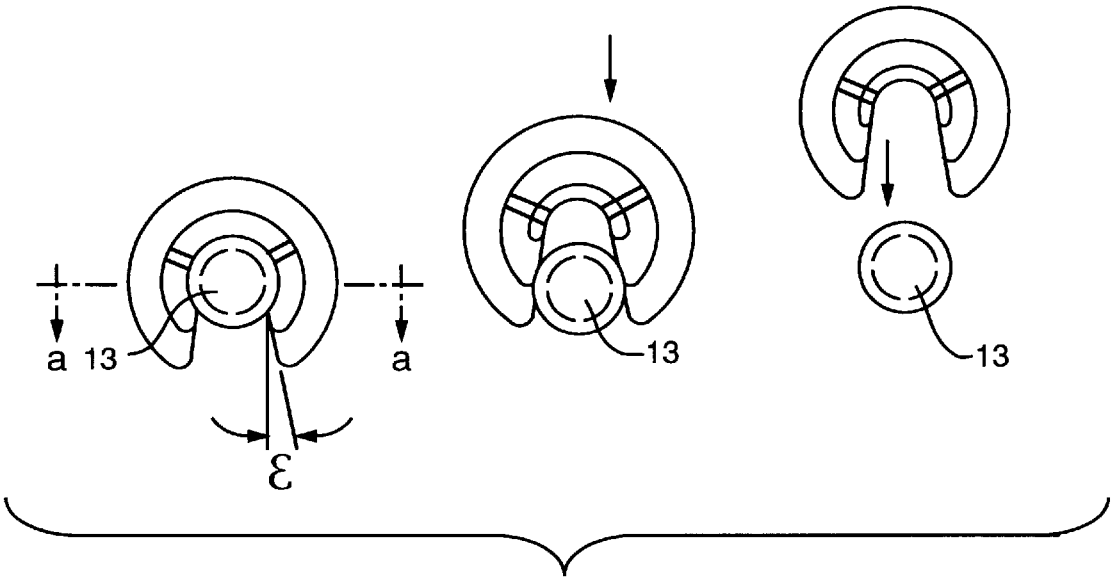
Figure 32:
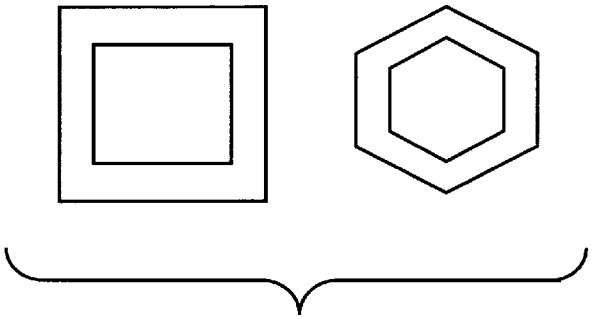

In the case of the embodiment illustrated in FIGS. 1 through 6, a shelf which comprises four vertical supports 13 and three horizontal construction members (shelf board members) 4 is constructed. The supports 13 comprise continuous bars 3 and spacer sleeves 2 which are pushed thereon. The shelf members 4 have cylindrical bores 5. Now, in accordance with the invention, the connection of the shelf members 4 to the supports 13 is made by way of connecting inserts 1 which preferably comprise plastic material. In the present structure illustrated by way of example the connecting inserts 1 in accordance with a preferred embodiment of the invention are of a two-part construction and comprise an upper part 1*o* and 1*u*. That two-part construction permits a simple and stable arrangement of the connecting inserts in the construction member 4, wherein the parts 1*o* and 1*u* of the connecting inserts are fitted one into the other in the region of the bore 5 in the construction members 4. The connecting inserts 1 project beyond the construction members 4 and form a stable lateral holding guide means 1*h* for the supports 13. As FIGS. 5 and 6 in particular show, the parts 1*o* and 1*u* of the connecting inserts have taperingly shaped contact surfaces 1*b*, wherein those contact surfaces include an angle $\alpha$ with the longitudinal direction 14. The spacer sleeves 12 of the supports 13, which sleeves are preferably made from plastic material, may have elastic properties and may thus be radially compressible. In order to promote this, there may be provided a slot 2*a*. Additionally or alternatively the ends 2*b* of the spacer sleeves 2 may also be of a taperingly reduced configuration, more specifically through an angle $\gamma$. With spacer sleeves 2 of that kind or with taperingly shaped receiving means 1*b* for the spacer sleeves 2 in the connecting insert 1 (inclination of the receiving means 1*b* again being the angle $\alpha$), when the system is loaded with a vertical force F caused by weight, a clamping force F or $F_R$ respectively directed transversely with respect thereto can be generated, as is shown in FIG. 6, whereby all essential parts of the construction system, namely the supports 13, the connecting inserts 1 and the construction members 4 are joined together to form a compact stable system. The greater the loading that is applied to the construction members which in the present case are in the form of shelf members, the more all the above-mentioned parts press against each other and the greater is the level of stability of the system.

Therefore on the one hand the connecting inserts 1 are held in clamping relationship in the respective bores 5 in the construction members 4 while on the other hand there is a clamping connection between the connecting inserts and the supports 13 (by way of the spacer sleeves 2 on the bars 3). In order to make it easier for the components to be radially pressed together, the connecting inserts are provided with slots 1*a*, as is clearly visible in particular in FIG. 2.

Flange-like abutments 1*f* in the interior of the connecting inserts 1 limit the depth of insertion of the supports 13 and the spacer sleeves 12 thereof respectively.

The level of stability of the connection is also further enhanced by the connecting inserts 1 each having respective preferably flange-like abutment surfaces 1*e* which bear against the construction member 4 laterally beside the bore 5.

The construction system according to the invention is quick and easy to construct and nonetheless stable. It is simple to produce, while in principle it is possible to use any material such as for example plastic material, wood or metal. In principle also the most widely varying dimensions are possible starting from small shelf units and toys or playthings up to large industrial shelf assemblies and framework structures. It will be appreciated that the shape of the bodies is not limited to the shelves illustrated. It is also possible to use bodies of an irregular shape. When the construction members, for example the shelf members, are subjected to a loading, a flexing effect occurs which is reduced by the system according to the invention as the construction members are braced in place, which additionally enhances the level of stability. Accordingly even relatively sensitive materials such as for example glass, plexiglass or relatively thin sheets or boards of wood can be used and can be loaded with relatively high eights.

We claim:

1. A construction system for building three-dimensional structures, having shelves with vertical supports, to which construction members are releasably secured, wherein the supports extend through bores or openings in the construction members, and wherein there is provided separate connecting inserts which can each be previously inserted in the region of a bore or opening in said construction members, said separate connecting inserts connecting the supports to the construction members, wherein the vertical supports comprise bars and separate spacer sleeves which can be pushed thereon, wherein the bars extend through the connecting inserts and the separate spacer sleeves are arranged between the construction members and are supported at the connecting inserts, the separate spacer sleeves of the supports having ends which are of a taperingly reduced configuration on the outside and; wherein the connecting inserts include receiving means comprising an inside surface having a taper with an orientation which is complementary to said taperingly reduced configuration of said separate spacer sleeves whereby the separate spacer sleeves and the connecting inserts are frictionally fitted together.

2. A construction system as set forth in claim 1 characterized in that the connecting inserts project beyond the respective construction members and comprise a lateral holding guide means for support.

3. A construction system as set forth in claim 1 characterized in that the connecting inserts have flanged abutments at the inside, which limit the depth of insertion of the spacer sleeves thereof.

4. A construction system as set forth in claim 1 characterized in that the connecting inserts comprise plastic material and are produced by an injection molding process.

* * * * *